United States Patent [19]

Orii

[11] Patent Number: 5,056,445

[45] Date of Patent: Oct. 15, 1991

[54] CONTROL SYSTEM FOR STOPPING SEWING MACHINE NEEDLE AT PREDETERMINED POSITION

[75] Inventor: Akira Orii, Hachioji, Japan

[73] Assignee: Janome Sewing Machine Industry Co., Ltd., Tokyo, Japan

[21] Appl. No.: 444,643

[22] Filed: Dec. 1, 1989

[30] Foreign Application Priority Data

Dec. 2, 1988 [JP] Japan ..... 63-304158

[51] Int. Cl.[5] ..... D05B 69/22

[52] U.S. Cl. ..... 112/275; 364/513

[58] Field of Search ..... 112/275, 277, 67, 87, 112/121.11, 2; 364/513

[56] References Cited

U.S. PATENT DOCUMENTS 4,777,585 10/1988 Kokawa et al. ..... 364/513 X 4,947,772 8/1990 Murakami et al. ..... 112/275 X

FOREIGN PATENT DOCUMENTS 0268485 11/1988 Japan ..... 112/275

*Primary Examiner*—Peter Nerbun

*Attorney, Agent, or Firm*—Dann, Dorfman, Herrell and Skillman

[57] ABSTRACT

A control system is provided for stopping a sewing machine needle at a predetermined position within its reciprocating path. An upper drive shaft rotating at a given rotational speed tends to decrease towards a predetermined lower rotational speed, responsive to a stop command signal. An electric motor is deenergized once the rotational speed reaches the predetermined value, and after that the upper drive shaft continues to rotate by inertia. A pulse number to be generated during the inertia rotation will be determined by an inclination of decrease of rotational speed. Another pulse number to be generated during a period when the stop command signal is generated and when the upper drive shaft rotational speed reaches the predetermined value is determined by application of a selective one or combination of prescribed fuzzy rules, so that the upper drive shaft will come to a standstill at a predetermined position or rotational angle, which governs the predetermined position of the needle.

11 Claims, 4 Drawing Sheets

CONTROL SYSTEM FOR STOPPING SEWING MACHINE NEEDLE AT PREDETERMINED POSITION

BACKGROUND OF THE INVENTION

1. Field of the Invention

This invention relates to a sewing machine in general and more particularly to a control system for stopping a sewing machine needle at a predetermined position.

2. Description of the Prior Art

An electric or electronic sewing machine has an upper drive shaft driven by an electric motor and a stitching needle connected to the upper drive shaft. One reciprocation of the needle in a vertical direction is governed by one rotation of the upper drive shaft to produce a stitch on a fabric.

The needle should preferably be stopped at a predetermined position, typically at an uppermost dead point or in some case at a lowermost dead point, after a desired series of stitch patterns have been produced on the fabric, which will facilitate the next stitching operation. Several control systems have been proposed for controlling the needle stop position.

FIG. 5 shows an example of the prior art control systems disclosed in Japanese patent provisional publication No. (Sho) 54-127752. While the upper drive shaft is rotating at a relatively high rotational speed, a stop command signal becomes "H" level at a time (tc). The rotational speed will therefore decrease proportionally toward a predetermined value, for example 120 r.p.m. This rotational speed is determined such that the upper drive shaft may soon come into a standstill within one rotation. After the upper drive shaft rotational speed has decreased below 120 r.p.m., the electric motor is deenergized at the next rise of a stop phase signal, at a time ($t_1$) in this example. Thus, the upper drive shaft rotational speed will further be decreased so that it stops at substantially a constant phase.

This prior art system, however, will not provide an accurate control. The inclination of decrease of the upper drive shaft rotational speed is varied with load fluctuation especially at a head portion of the sewing machine. If the sewing machine has a greater load, the rotational speed decreases more rapidly so that the needle stopping position would be offset from a predetermined position, as shown by dotted lines.

This defect could be eliminated by another prior art control system shown in FIG. 6 which is disclosed in Japanese patent provisional publication No. (Sho) 63-262080. In this prior art, load fluctuation is previously calculated to determine a corresponding pulse number of a pulse signal, which generates 360 pulses per rotation, for example. The electric motor is deenergized at a time (ts) which comes after counting the pulse number thus determined from a time ($t_1$) when the upper drive shaft rotational speed has been lowered below a predetermined value or 140 r.p.m. in this example. Thus, it is expected that the upper drive shaft may always be stopped at a time ($t_2$) to provide a constant needle stopping position. However, since the inclination of decrease of the upper drive shaft rotational speed is not directly determined, the actual needle stopping position would be varied due to a sudden load change. Furthermore, if the upper drive shaft rotational speed decreases as shown by double dotted lines, this prior art system discriminates that the rotational speed is still higher than the predetermined value, namely 140 r.p.m. at ($t_1$) so that an additional one rotation will be required, although in this case the upper drive shaft can be stopped at a predetermined phase or position within one rotation.

SUMMARY OF THE INVENTION

It is therefore an object of this invention to obviate the above-mentioned disadvantages of the prior art control system.

Another object of this invention is to provide a novel control system for stopping a sewing machine needle at a predetermined position, with high accuracy even under load fluctuations.

According to an aspect of this invention there is provided a control system for stopping at a predetermined position a vertically reciprocating needle of a sewing machine including an electric motor and an upper drive shaft connected at one end to the electric motor to be driven thereby, the needle being connected to the other end of the upper drive shaft to be vertically reciprocated in synchronism with rotation of the upper drive shaft, which comprises: means for generating a signal commanding that rotational speed of the upper drive shaft decrease toward a predetermined rotational speed (NS); and fuzzy theory applying means operated in response to said signal generating means, a rotational speed difference ($N\theta_1$–$N\theta_2$) between two rotational angles ($\theta_1$, $\theta_2$) of the upper drive shaft and a rotational speed ($N\theta_2$) at the second rotational angle ($\theta_2$) to thereby output a control command to the electric motor for controlling that the upper drive shaft comes to a standstill at a predetermined rotational angle ($\theta_3$).

This invention has been prepared by practical application of the known fuzzy theory which was proposed originally by Professor Lotfi A. Zadeh, California Univ. in 1964 for dealing with a set of ambiguous conceptions or "fuzzy set". Fuzzy set is defined by a specific "membership function" to lead out a "membership value" ranging between 0 and 1.

BRIEF DESCRIPTION OF THE DRAWINGS

Further objects and advantages of this invention can be fully understood from the following detailed description when read in conjunction with the accompanying drawings in which.

DETAILED DESCRIPTION OF THE EMBODIMENT

The control system embodying the invention is applied to an electronic sewing machine which includes, as well known in the art, an electric motor, an upper drive shaft driven by the electric motor and a stitching needle connected to the upper drive shaft and reciprocated in a vertical direction along with rotation of the upper drive shaft. The electric motor employed is a PCM (pulse width modulation) controlled DC motor. The rotational speed of the upper drive shaft is detected by means of an encoder which generates 360 pulses per one rotational speed.

Figure 1:
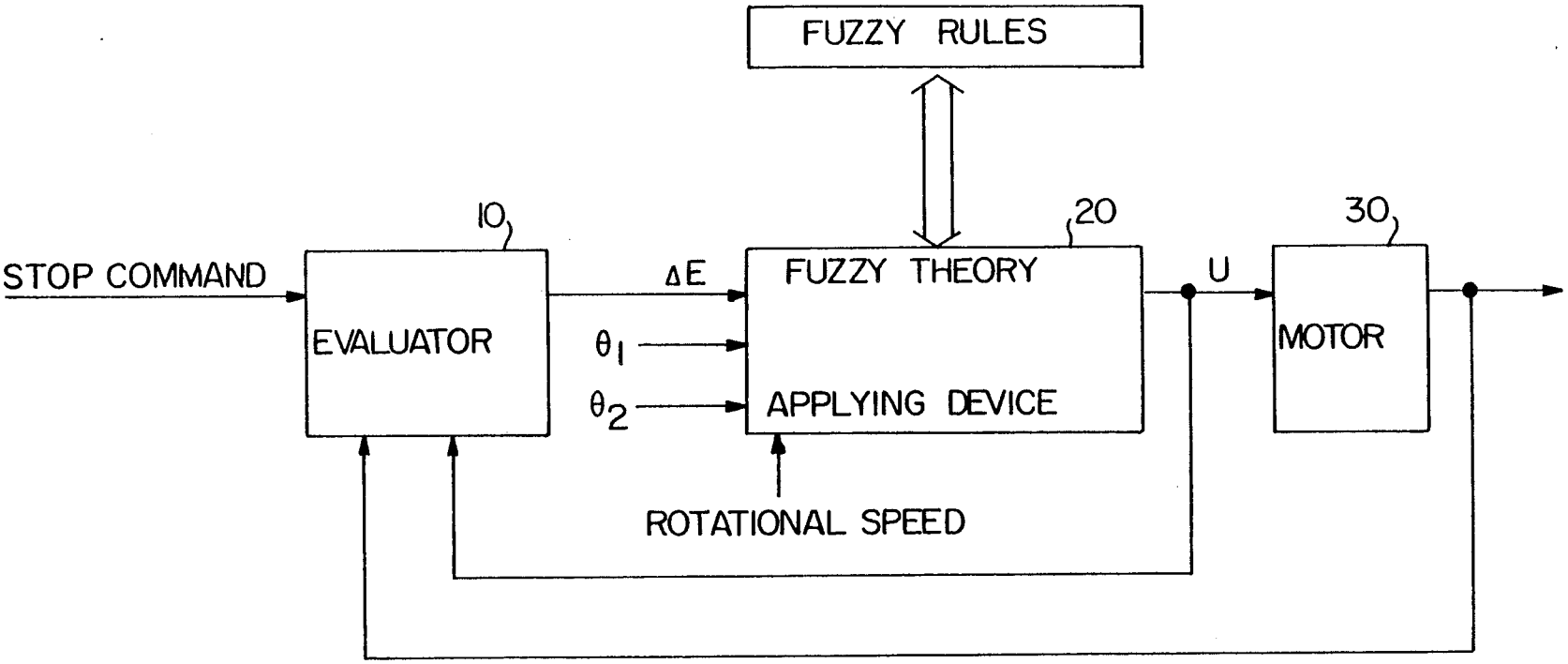
FIG. 1 is a block diagram illustrating an overall arrangement of a control system embodying the invention.

As shown in FIG. 1, the control system comprises an evaluator 10 operated in response to a stop command signal to output a signal ΔE representing a difference in needle stop positions between a theoretical one and an actual one. The output signal ΔE is inputted to a fuzzy theory applying device 20. To the fuzzy theory applying device 20 are also inputted signals representing rotational speeds ($N\theta_1$) and ($N\theta_2$) of the upper drive shaft at two specific rotational angles ($\theta_1$) and ($\theta_2$), respectively, which can be detected by the encoder (not shown). Responsive to these inputs, the fuzzy theory applying device 20 is operated to output a control command U in accordance with a selective combination of prescribed fuzzy rules, to be described later. The control command U is supplied to the DC motor 30 which is controlled thereby to stop the needle at a predetermined theoretical position. Data representing such theoretical position is also supplied to the evaluator 10. The needle may, however, be stopped at another position in actual operation. Such actual needle stop position is measured and corresponding data is supplied to the evaluator 10. Upon input of these data, the evaluator generates the difference or deviation ΔE between the theoretical position and the actual position of the needle.

Figure 4:
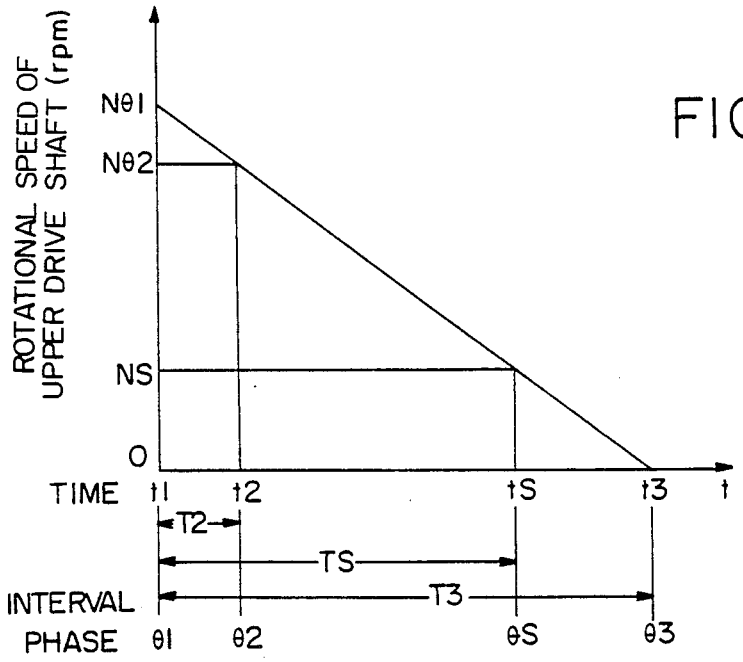
FIG. 4 is a graph showing an example of declination of the upper drive shaft rotational speed, which may be cited for explaining how algebraic equations relevant to the fuzzy rules are determined.
Figure 5:
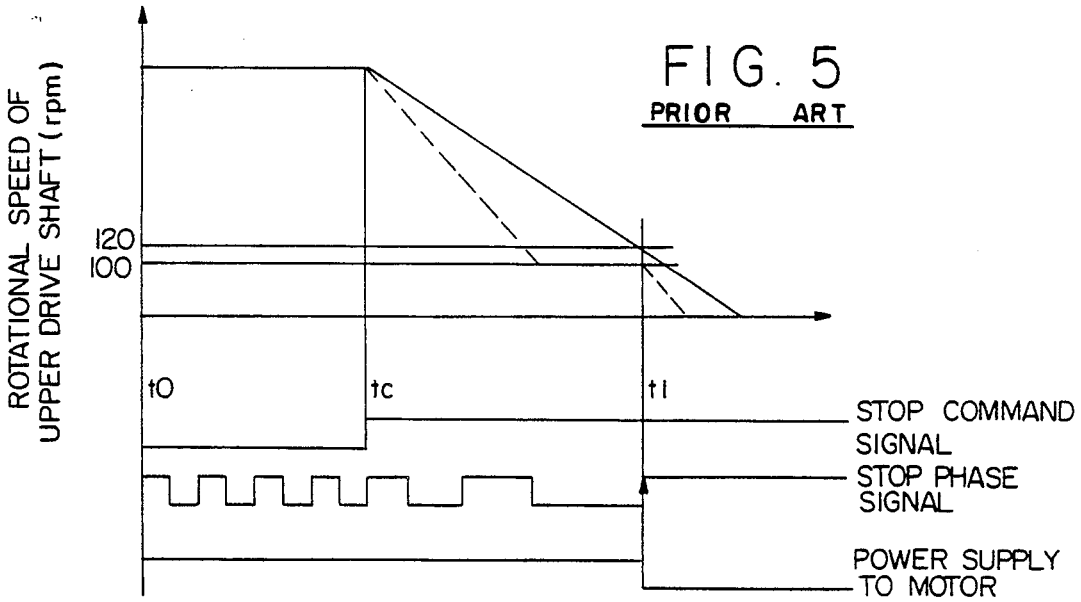
FIG. 5 PRIOR ART
FIGS. 5 and 6 are explanatory views showing the manner of control operation performed by the prior art.
Figure 6:
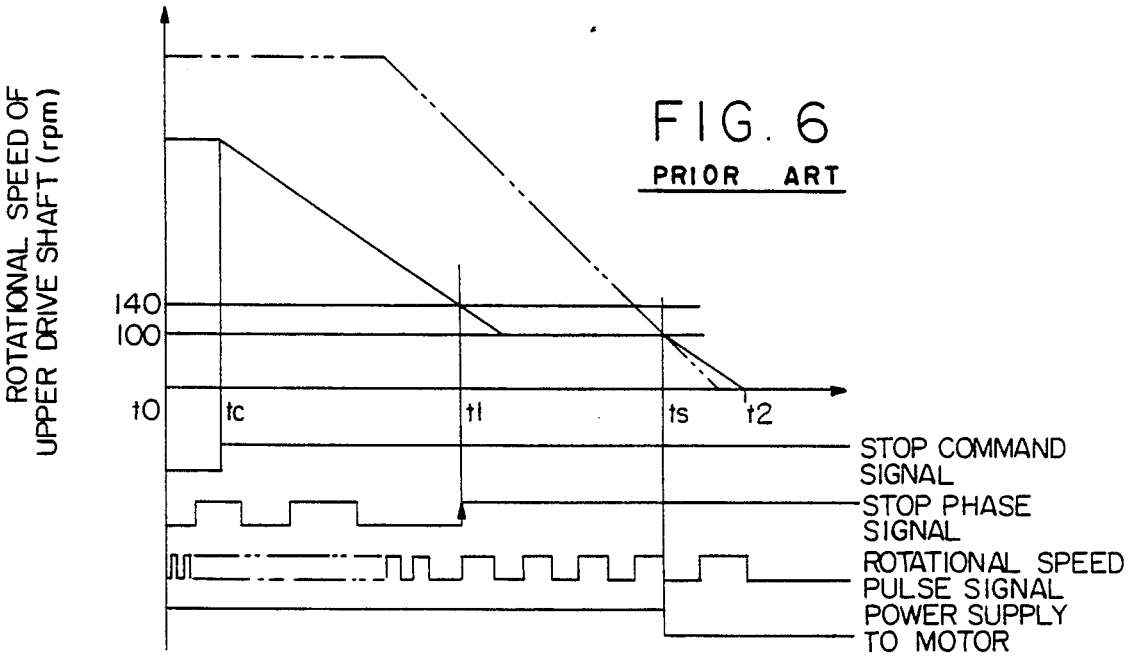
FIG. 6 PRIOR ART

Before explaining a series of the fuzzy rules to be applied in operation of the fuzzy theory applying device 20, several algebraic equations related thereto will be described hereunder, in reference to FIG. 4.

DETERMINATION OF DECLINATION OF REVOLUTION

Declination of the upper drive shaft rotational speed may be considered to be represented by a linear equation, that is:

$$N=At+B \tag{1}$$

where N represents a rotational speed of the upper drive shaft, t a time, and A and B unknown constants.

Suppose $t_1=0$ for convenience' sake, following equations can be lead out:

$$B=N\theta_1 \tag{2}$$

$$\begin{aligned} A &= (N\theta_1 - N\theta_2)/(t_1 - t_2) \\ &= (N\theta_1 - N\theta_2)/T_2 \end{aligned} \tag{3}$$

$$\begin{aligned} T_2 &= \frac{(\theta_1 - \theta_2)}{(N\theta_1 + N\theta_2)/2 * 360/60} \\ &= (\theta_1 - \theta_2)/3(N\theta_1 - N\theta_2) \end{aligned} \tag{4}$$

The equation (4) is inserted into the equation (2) to lead out the declination which can be represented by:

$$A=3\{(N\theta_2)^2-(N\theta_1)^2\}/(\theta_2-\theta_1) \tag{5}$$

The equations (2) and (5) are inserted into the equation (1) so that the upper drive shaft rotational speed may be represented by the following equation (6):

$$N=3\{(N\theta_2)^2-(N\theta_1)^2\}t/(\theta_2-\theta_1)+N\theta_1 \tag{6}$$

DETERMINATION OF STOPPABLE CONDITION

A condition required for stopping the upper drive shaft at a time ($t_8$) will be determined. $t+t_3$ and $N=0$ are inserted into the equation (1) to lead out:

$$0=3\{(N\theta_2)^2-(N\theta_1)^2\}t_8/(\theta_2-\theta_1)+N\theta_1 \tag{7}$$

The following equation (8) can be obtained similar to the equation (4):

$$T_3=(\theta_3-\theta_1)/3N\theta_1 \tag{8}$$

The equation (8) is inserted into the equation (7) to lead out:

$$0=(N\theta_2)^2(\theta_3-\theta_1)-(N\theta_1)^2(\theta_3-\theta_2) \tag{9}$$

Accordingly, the required condition can be represented by the following equation (10):

$$Fa\leqq 0 \tag{10}$$

where $Fa=(N\theta_2)^2(\theta_3-\theta_1)-(N\theta_1)^2(\theta_3-\theta_2)$

DETERMINATION OF INERTIA ROTATIONAL SPEED PULSE NUMBER

Even when a power supply to the electric motor is broken off at ($t_s$) at which time the upper drive shaft rotational speed has just decreased to the predetermined value (NS), namely 100 r.p.m. in this example, the upper drive shaft will continue to rotate by inertia. A pulse number (PS) counted by the encoder between ($t_s$) and ($t_3$) will now be determined:

$$\begin{aligned} t_3 - t_s &= (\theta_3 - \theta_s)/(NS/2 * 360/60) \\ &= (\theta_3 - \theta_s)/3NS \end{aligned} \tag{11}$$

$$\therefore PS = \theta_3 - \theta_s = 3NS(t_3 - t_s) \tag{12}$$

The declination of the upper drive shaft rotational speed can be represented by the equation (5). Suppose that the upper drive shaft rotational speed decreases after ($t_s$) with the same declination as between ($t_1$) and ($t_3$), the declination can also be represented by:

$$A=-NS/(t_3-t_s) \tag{13}$$

$$t_3-t_3=-NS/A \tag{14}$$

The equation (14) is inserted into the equation (12) to lead:

$$PS=-3(NS)^2/A \tag{15}$$

The equation (5) is inserted into the equation (15) so that the inertia rotational speed pulse number (PS) may be given by the following equation (16):

$$PS = -(NS)^2(\theta_2-\theta_1)/\{(N\theta_2)^2-(N\theta_1)^2\} \quad (16)$$

DETERMINATION OF CONTROL PULSE NUMBER

A control pulse number (Pa) which is determined by the control command U and counted by the encoder between the rotational phases $\theta_2$ and $\theta_s$, or between times $t_2$ and $t_s$, can be represented by:

$$Pa=\theta_5-\theta_2=(\theta_3-\theta_2)-(\theta_3-\theta_s) \quad (17)$$

The equations (5) and (15) are inserted into the equation (17) so that the control pulse number (Pa) can be represented by the following equation (18):

$$\begin{aligned} Pa &= (\theta_3-\theta_2)+3(NS)^2/A \\ &= \theta_3-\theta_2+(NS)^2(\theta_2-\theta_1)/\{(N\theta_2)^2-(N\theta_1)^2\} \end{aligned} \quad (18)$$

Six fuzzy rules to be applied in operation of the fuzzy theory applying device 20 are illustrated in FIG. 2, which will now be described in detail.

RULE 1: DISCRIMINATION OF LINEAR DECLINATION

Figure 2A:
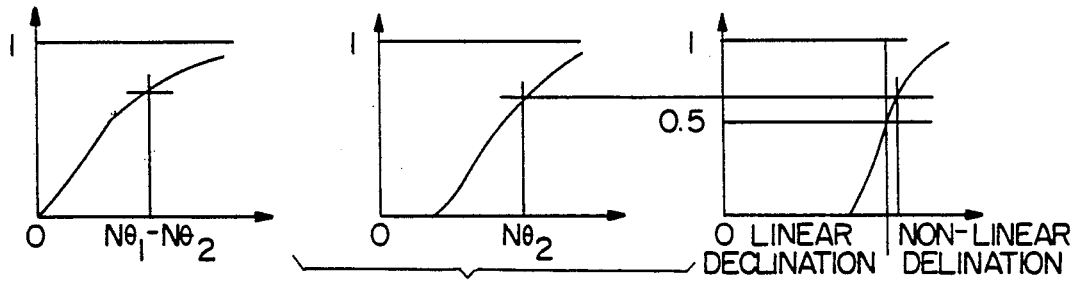
FIG. 2*a* is a set of related plots which are compared in application of fuzzy Rule 1 relating to discrimination of linear declination.

This rule is first applied, using FIG. 2*a*, for determining if the upper drive shaft rotational speed is on the way to decrease proportionally. More particularly, in accordance with a first membership function regarding a rotational speed difference ($N\theta_1$–$N\theta_2$) at first and second rotational angles $\theta_1$ and $\theta_2$ of the upper drive shaft, which is a parameter on the abscissa, a first membership value ranging between 0 and 1 may be obtained on the ordinate. A second membership function regarding a rotational speed $N\theta_2$ at the second rotational angle $\theta_2$ lying on the abscissa, is prepared for obtaining a second membership value on the ordinate. In accordance with one of the first and second membership values thus obtained of a lower value, a third membership function is applied for determining if the rotational speed variation between the rotational angles $\theta_1$ and $\theta_2$ has a linear relation, in which case the control operation according to the invention can be performed. If the first rotational speed $N\theta_2$ is not so much lower than the second rotational speed $N\theta_1$ and/or if the rotational speed $N\theta_2$ is not so high, the third membership function discriminates that the rotational speed variation can not be considered as a linear declination.

RULE 2: DISCRIMINATION OF IMMEDIATE STOPPABLE CONDITION

This rule is applicable when the rotational speed variation between the first and second rotational angles $\theta_1$ and $\theta_2$ can be considered as a linear declination, as a result of application of Rule 1. Using FIG. 2*b* with the previously calculated value Fa (see equation (10)) as a parameter, a membership value is determined in accordance with a single membership function. If the membership value obtained is smaller than 0.5 which means $Fa>0$, the required stoppable condition is not fulfilled so that the upper drive shaft should be subjected to an additional one rotation. If the membership value obtained is 0.5 or larger which means $Fa\leqq 0$, the control operation proceeds to Rule 3.

RULE 3: DISCRIMINATION OF CONTROL PULSE NUMBER

Figure 3:
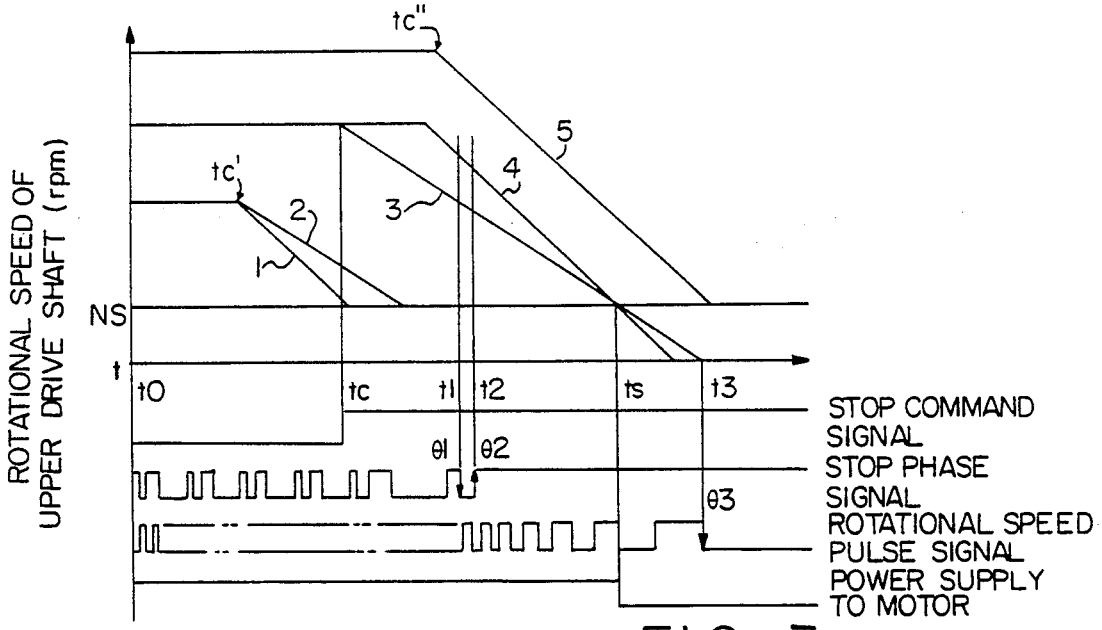
FIG. 3 is an explanatory view showing a manner of control operation performed by the embodiment.

This rule applies to FIG. 3 and includes first and second membership functions with parameters of the previously determined inertia rotational speed pulse number (PS) and the rotational speed ($N\theta_2$) at the second rotational angle ($\theta_2$), respectively. Among the membership values obtained on the ordinates of the respective membership functions, a lower value is adopted so that a pulse number (P) to be counted between the second rotational angle ($\theta_5$) and an advanced rotational angle ($\theta_s$) at which time the electric motor is deenergized. By optimum control of the pulse number (P), it will be possible to stop the upper drive shaft at a predetermined rotational angle ($\theta_3$). In this embodiment, a plurality of membership functions $P_1$ to $P_4$ have been prepared so that different four pulse numbers (P) are obtained.

RULE 4: DETERMINATION OF CONTROL PULSE NUMBER

The pulse numbers (P) obtained at the respective membership functions $P_1$ to $P_4$ are compared with the pulse number (Pa) which has been determined by the equation (18). Such comparison is carried out also by fuzzy assumption in which these pulse numbers (P) and (Pa) are employed as parameters of a membership function (not shown). In accordance with the result of such fuzzy assumption, the pulse number (P) is finally determined by again applying Rule 3. The pulse number (P) thus determined is data-processed into the control command U which is outputted from the fuzzy theory applying device 20 toward the DC motor 30 and the evaluator 10 respectively.

RULE 5: SET THE LAST CONTROL PULSE NUMBER IN CASE OF NON-LINEAR DECLINATION

This rule is applied when the result of application of Rule 1 is such that the rotational speed change between the rotational angles ($\theta_1$) and ($\theta_2$) can not be deemed as a linear declination. In this case, the pulse number (P) which was determined in the last control operation and stored in a memory, is employed for convenience's sake.

RULE 6: REARRANGE MEMBER FUNCTIONS IN RULE 3

This rule is provided for correction of the pulse number (P). If the total sum (PC) of the pulse number (P) obtained in Rule 4 or Rule 5 and the inertia rotational speed pulse number (PS) should disagree with an actual pulse number (Pf) to be counted from the second rotational phase ($\theta_2$) to an advanced rotational phase at which the upper drive shaft actually comes to a standstill, the membership functions $P_1$ to $P_4$ provided in Rule 3 is corrected accordingly for the future control operation.

Figure 2B:
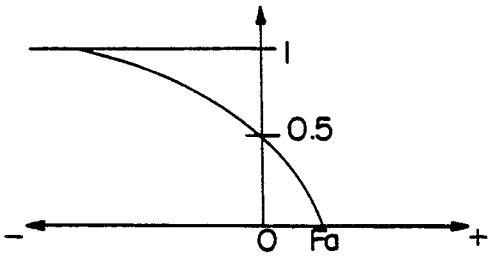
FIG. 2*b* is a plot for implementing fuzzy Rule 2 relating to discrimination of immediate stoppable condition.
Figure 2C:
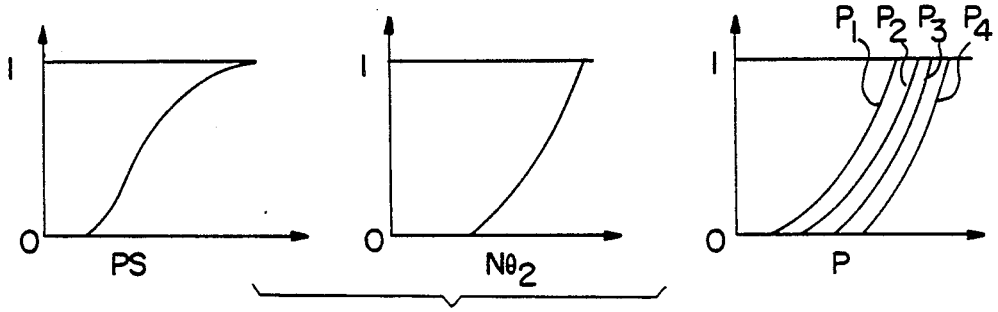
FIG. 2*c* is a set of related plots which are compared in application of fuzzy Rule 3 relating to discrimination of control pulse number.

With reference to FIGS. 2*a*, 2*b* and 2*c*, the control operation effected by the embodiment utilizing the fuzzy rules 1 to 6 will now be described.

CASE 3

The upper drive shaft is rotating at an average rotational speed on the order of 500 r.p.m. at a time ($t_0$). If the stop command signal is generated at a time (tc), the rotational speed starts to decrease proportionally toward the predetermined value (NS) or 100 r.p.m. in this example. Before the rotational speed reaches to the predetermined value (NS) at a time (ts), the stop phase signals are generated when the upper drive shaft shows two different rotational angles ($\theta_1$) and ($\theta_2$) at times ($t_1$) and ($t_2$), respectively. In this case, application of Rule 1 discriminates that the rotational speed decreases as a linear declination and the control operation proceeds to Rule 2.

Rule 2 discriminates if the upper drive shaft can be stopped at the objective position or rotational angle ($\theta_2$). If the membership value obtained is smaller than 0.5, one more rotation of the upper drive shaft is required. The control operation proceeds to Rule 3 if the discrimination result of Rule 2 is favorable.

The pulse number (P) to be counted from ($t_2$) to (ts) should be determined by application of Rule 3 and Rule 4. The pulse number (P) is used with the predetermined inertia rotational speed pulse number (PS) to determine a pulse number from ($t_2$) to ($t_3$) whereby it is expected that the upper drive shaft rotational speed may be terminated at the objective phase ($\theta_3$).

The pulse number (P) thus determined is decreased one by one in response to each pulse generated from the rotational speed sensor or encoder. The DC motor is deenergized once the pulse number (P) is decreased to zero at (ts). The upper drive shaft will continue to rotate by inertia even after (ts) but its rotational speed would be terminated at the objective angle ($\theta_3$) at ($t_3$), after the predetermined inertia rotational speed pulse number (PS).

CASE 4

The control operation is processed substantially in the same manner as in Case 3, though the stop command signal generating timing (tc) and the rotational speed terminating timing (t3) are not the same. Case 4 has more steep declination of the rotational speed decrease, meaning that there involves a larger degree of load in the sewing machine.

CASES 1 AND 2

The upper drive shaft is rotating at a lower rotational speed for example 200–300 r.p.m., at a time ($t_0$). Responsive to the stop command signal generating at (tc'), the upper drive shaft rotational speed turns to decrease toward the predetermined rotational speed (NS). After reaching the predetermined rotational speed (NS), this rotational speed is maintained to wait the stop phase signals generated at ($t_1$) and ($t_2$) when the upper drive shaft comes to the rotational angles ($\theta_1$) and ($\theta_2$) respectively. In these cases, therefore, application of Rule 1 is followed by Rule 5 so that the pulse number (P) which was stored as one adopted in the last control command U will be employed. A power supply to the DC motor is discontinued once the pulse number (P) is decreased to zero. The upper drive shaft will continue to rotate by inertia even after deenergizing the DC motor but its rotational speed would be terminated at the objective phase after the predetermined inertia rotational speed pulse number (PS).

CASE 5

This is the case wherein the upper drive shaft is rotating at a high rotational speed for example 1000 r.p.m. or more. The control operation is performed by application of Rule 1 followed by Rule 2. In this case, the membership value obtained in Rule 2 would be smaller than 0.5, requiring one more rotation. It would be anticipated that the rotational speed has already been decreased to the predetermined value (NS) before the times ($t_1$) and ($t_2$) within the next rotation. Therefore, the pulse number (P) is determined as in the cases 1 and 2.

Although the invention has been described in conjunction with a specific embodiment thereof, it is to be understood that many variations and modifications may be made without departing from the spirit and scope of the invention as defined in the appended claims.

What is claimed is:

1. A control system for stopping at a predetermined position a vertically reciprocating needle of a sewing machine including an electric motor and an upper drive shaft connected at one end to the electric motor to be driven thereby, the needle being connected to the other end of the upper drive shaft to be vertically reciprocated in synchronism with rotation of the upper drive shaft, said control system comprising:

means for generating a signal commanding that rotational speed of the upper drive shaft decrease toward a predetermined rotational speed (NS); and fuzzy theory applying means operated in response to said means for generating a signal, the fuzzy theory applying means responding to inputs of rotational speed difference ($N\theta_1$–$N\theta_2$) at two specific rotational angles ($\theta_1$, $\theta_2$) of the upper drive shaft and a rotational speed ($N\theta_2$) at the second rotational angle ($\theta_2$) to thereby output a control command to the electric motor to bring the upper drive shaft to a standstill at a predetermined rotational angle ($\theta_3$).

2. The control system according to claim 1 wherein said fuzzy theory applying means is provided with a plurality of fuzzy rules, at least one of said fuzzy rules being applied to output said control command.

3. The control system according to claim 2 wherein the rotational speed difference ($N\theta_1$–$N\theta_2$), the rotational speed ($N\theta_2$) at the second rotational angle ($\theta_2$), the predetermined rotational speed (NS), the predetermined rotational angle ($\theta_3$) and other values calculated from these values are employed in application of said fuzzy rules.

4. The control system according to claim 3 wherein said fuzzy rules include a first rule which discriminates if rotational speed of the upper drive shaft is declining linearly, in response to a smaller one of first and second membership values, said first and second membership values being obtained by a first membership function regarding a first parameter of the rotational speed difference ($N\theta_1$–$N\theta_2$) and a second membership function regarding a second parameter of the rotational speed ($N\theta_2$), respectively.

5. The control system according to claim 4 wherein said fuzzy rules include a second rule which discriminates if the upper drive shaft may be stopped at the predetermined rotational angle ($\theta_3$) within one rotation.

6. The control system according to claim 5 wherein said second rule comprises a membership function regarding the following parameter (Fa):

$$Fa=(N\theta_2)^2(\theta_3-\theta_1)-(N\theta_1)^2(\theta_3-\theta_2).$$

7. The control system according to claim 6 wherein said fuzzy rules include a third rule comprising a first membership function regarding a parameter of an inertia rotational speed pulse number (PS) which represents a pulse number to be counted while the upper drive shaft continues to rotate by inertia even after deenergizing the electric motor and which is represented by the equation: $PS=-3(NS)^2/A$, where A represents an inclination of decrease of the upper drive shaft rotational speed; a second membership function regarding a parameter of the rotational speed ($N\theta_2$) at the second rotational angle ($\theta_2$); and a third membership function for determining a control pulse number (P) responsive to a smaller one of membership values obtained by the first and second membership functions of said third rule, said control pulse number (P) being a number of pulses to be counted between a time ($t_2$) when the upper drive shaft has the second rotational angle ($\theta_2$) and another time (ts) when the electric motor is deenergized.

8. The control system according to claim 7 wherein said third rule is provided with a plurality of third membership functions to obtain a plurality of the control pulse numbers (P).

9. The control system according to claim 8 wherein said fuzzy rules includes a fourth rule which discriminates if a number of pulses (Pf) to be actually generated from the time ($t_2$) and until rotation of the upper drive shaft is terminated at another time ($t_3$) is in agreement with the respective control pulse numbers (P) plus the inertia rotational speed pulse number (PS), to thereby select the most reliable control pulse number (P) in the control command to be outputted to the electric motor.

10. The control system according to claim 9 wherein said fuzzy rules includes a fifth rule which discriminates that the selected control pulse number (P) is adopted when the result of discrimination of said first rule is such that rotational speed of the upper drive shaft is not decreasing.

11. The control system according to claim 10 wherein said fuzzy rules includes a sixth rule for correcting the third membership functions regarding the control pulse number so that the selected control pulse number (P) thus obtained plus the inertia rotational speed pulse number (PS) is consistent with the actual number of pulses (Pf).

* * * * *

UNITED STATES PATENT AND TRADEMARK OFFICE

CERTIFICATE OF CORRECTION

PATENT NO. : 5,056,445

DATED : October 15, 1991

INVENTOR(S) : AKIRA ORII

It is certified that error appears in the above-identified patent and that said Letters Patent is hereby corrected as shown below:

Column 4, line 18,

"$0=3\{(N\theta_2)^2-(N\theta_1)^2\}t_8/(\theta_2-\theta_1)+N\theta_1$ (7)"

should be --$0=3\{(N\theta_2)^2-(N\theta_1)^2\}t_3/(\theta_2-\theta_1)+N\theta_1$ (7)--;

Column 4, line 60,

"$t_3-t_3=-NS/A$ (14)"

should be --$\therefore t_3-t_s=-NS/A$ (14)--.

Column 5, line 12,

"$Pa=\theta_5-\theta_2=(\theta_3-\theta_2)-(\theta_3-\theta_s)$ (17)"

should be --$Pa=\theta_s-\theta_2=(\theta_3-\theta_2)-(\theta_3-\theta_s)$ (17)--.

Column 6, line 12, "$(\theta_5)$" should be --$(\theta_2)$--.

Column 7, line 11, "$(\theta_2)$" should be --$(\theta_3)$--.

Signed and Sealed this

Second Day of March, 1993

*Attest:*

STEPHEN G. KUNIN

*Attesting Officer*

*Acting Commissioner of Patents and Trademarks*